United States Patent [19]

Ver Mehren

[11] 4,210,318

[45] Jul. 1, 1980

[54] FAN FOLDING AND STACKING DEVICE

[75] Inventor: Hubert R. Ver Mehren, Florissant, Mo.

[73] Assignee: Ga-Vehren Engineering Company, St. Louis, Mo.

[21] Appl. No.: 909,020

[22] Filed: May 24, 1978

[51] Int. Cl.[2] ..... B65H 45/20

[52] U.S. Cl. ..... 270/79; 270/61 F

[58] Field of Search ..... 270/79, 61 F, 39; 226/104–107, 113, 114, 119; 93/84 R

[56] References Cited

U.S. PATENT DOCUMENTS

| | | | |
|---|---|---|---|
| 2,729,445 | 1/1956 | Webster | 270/39 |
| 3,544,099 | 12/1970 | Cooke | 270/79 |
| 3,640,521 | 2/1972 | Hutley | 270/61F |

FOREIGN PATENT DOCUMENTS

| | | | |
|---|---|---|---|
| 604811 | 10/1934 | Fed. Rep. of Germany | 270/73 |

OTHER PUBLICATIONS

IBM Disclosure Bulletin, Form Creasing, Folding and Refolding Machine, W. J. Lavin & T. E. Schall, vol. 7, No. 4, Sep. 1974.

*Primary Examiner*—Paul T. Sewell
*Assistant Examiner*—A. Heinz
*Attorney, Agent, or Firm*—Cohn, Powell & Hind

[57] ABSTRACT

This device is for use for fan-folding and stacking a continuous web of business forms and operates as the last stage of such processing machine. The device includes a pair of rotatable paddle wheels disposed on each side of the processing machine frame and having an axis of rotation perpendicular to the longitudinal axis of the frame. Each paddle wheel includes a hub rotatable in a plane parallel to the axis of the frame and a plurality of radially extending lengthwise adjustable arms pivotally attached to the hub for transverse movement out of and into the plane of rotation of the hub for selective engagement with the continuous web. The transverse movement of the arms is controlled by a circular cam fixedly attached to the frame and engageable by cam followers attached to said arms.

12 Claims, 7 Drawing Figures

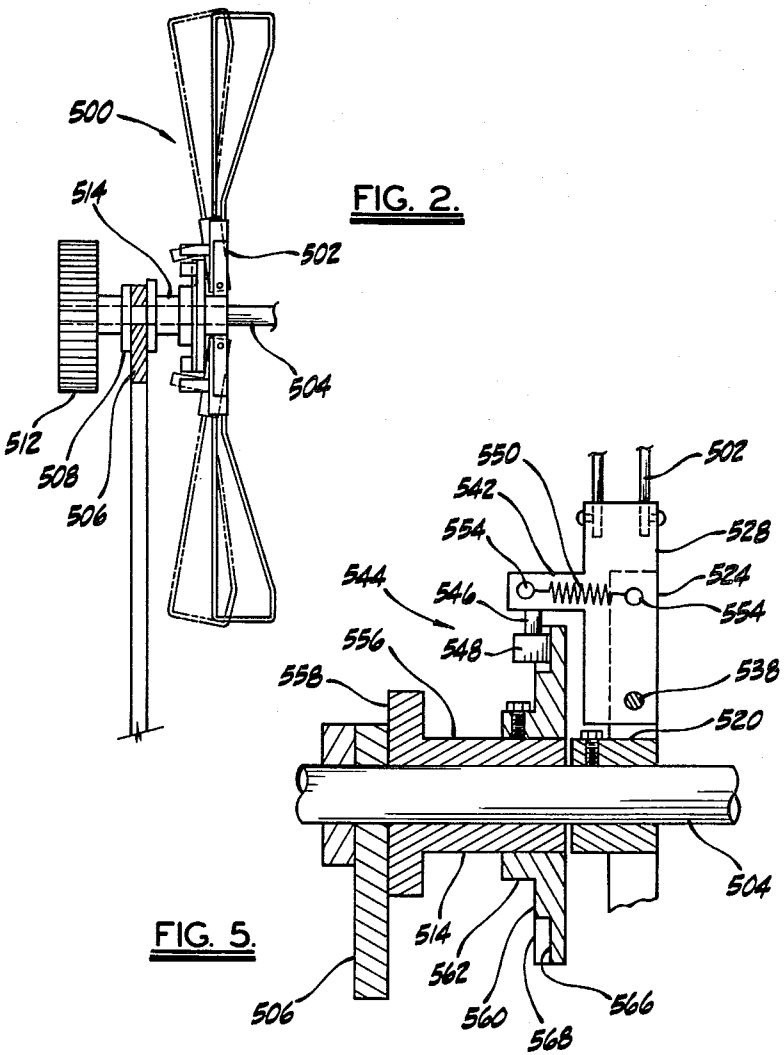
FIG. 5.
FIG. 2.
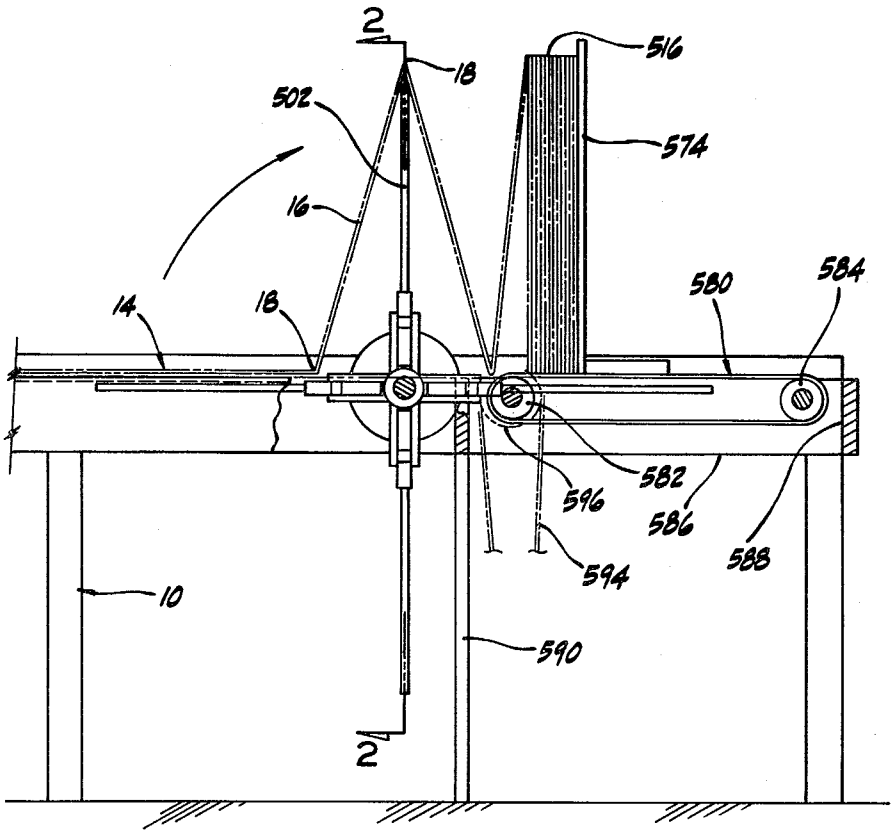
FIG. 1.

FAN FOLDING AND STACKING DEVICE

BACKGROUND OF THE INVENTION

This invention refers generally to the folding and stacking of continuous webs and particularly to fan-folding and stacking of business forms having predetermined transverse fold lines.

The fan-folding and stacking of individual business forms imprinted on a continuous web and processed through various stages is conventionally accomplished by providing a low level support for the folding web at the end of the processing machine and providing some means of transferring the web, during folding, from the processing table to the support.

One method for achieving this fan-folding and stacking and the apparatus by which it is accomplished is disclosed in U.S. Pat. No. 3,674,254. The apparatus utilizes a pair of upstanding, eccentrically mounted blade assemblies which operate intermittently. This apparatus is somewhat complicated and requires mechanism by which the blade assemblies are alternately placed in a temporary hold position and a moving position.

The present fan-folding and stacking device is considerably less complicated and more effective than known prior art devices.

SUMMARY OF THE INVENTION

This fan-folding and stacking device provides means of fan-folding and stacking the individual sections of a continuous web of business forms and includes a plurality of radial arms rotatable about an axis transverse to the axis of the web and means for selectively actuating the arms into and out of engagement with said web to raise, fold and stack said web sections.

The device is mounted to the support frame of a processing machine having a longitudinal axis and opposed sides and conveying means for the web. The device includes oppositely disposed cam means fixedly attached to the frame and a pair of rotatable paddle wheels mounted to the frame in side-by-side relation for rotation about an axis transverse to the longitudinal axis of the frame and in a plane generally parallel to said longitudinal axis. Each paddle wheel includes a hub and a plurality of radial arms extending outwardly of the hub, said arms being pivotally connected to the hub for transverse movement relative to the general plane of rotation. Each radial arm includes a cam follower which is engageable with the fixed cam means and provides a means by which the arms are tilted into and out of engagement with the continuous web as the hub rotates.

The fixed cam means includes a cam track disposed about the axis of rotation of the hub and the track is provided with inner and outer arcuate portions engageable by the cam follower.

Spring bias means is connected between the radial arm and the hub tending to urge the arms inwardly into overlapping engagement with the web.

The rotatable hub includes a plurality of bifurcated radial portions and each radial arm includes a base portion pivotally connected between said radially extending portions, and an elongate removable, radially extending loop portion connected to the base portion, said loop portion being removable for replacement loop portion of different length capable of handling a different size of individual business form.

The fixed cam is adjustable transversely of the web to accommodate a different width of web.

The stacking device is provided with a drive assembly which permits the web to be driven at constant speed and the variation in length of the individual web sections to be catered for by changing the angular speed of the paddle wheels.

BRIEF DESCRIPTION OF THE DRAWINGS

FIG. 1 is an enlarged fragmentary elevational view of the stacking and foldng device partly in cross section;

FIG. 2 is a fragmentary cross sectional view taken on line 2—2 of FIG. 1;

FIG. 5 is a cross sectional view taken on line 5—5 of FIG. 4;

DESCRIPTION OF THE PREFERRED EMBODIMENT

Figures 3, 4, 6:
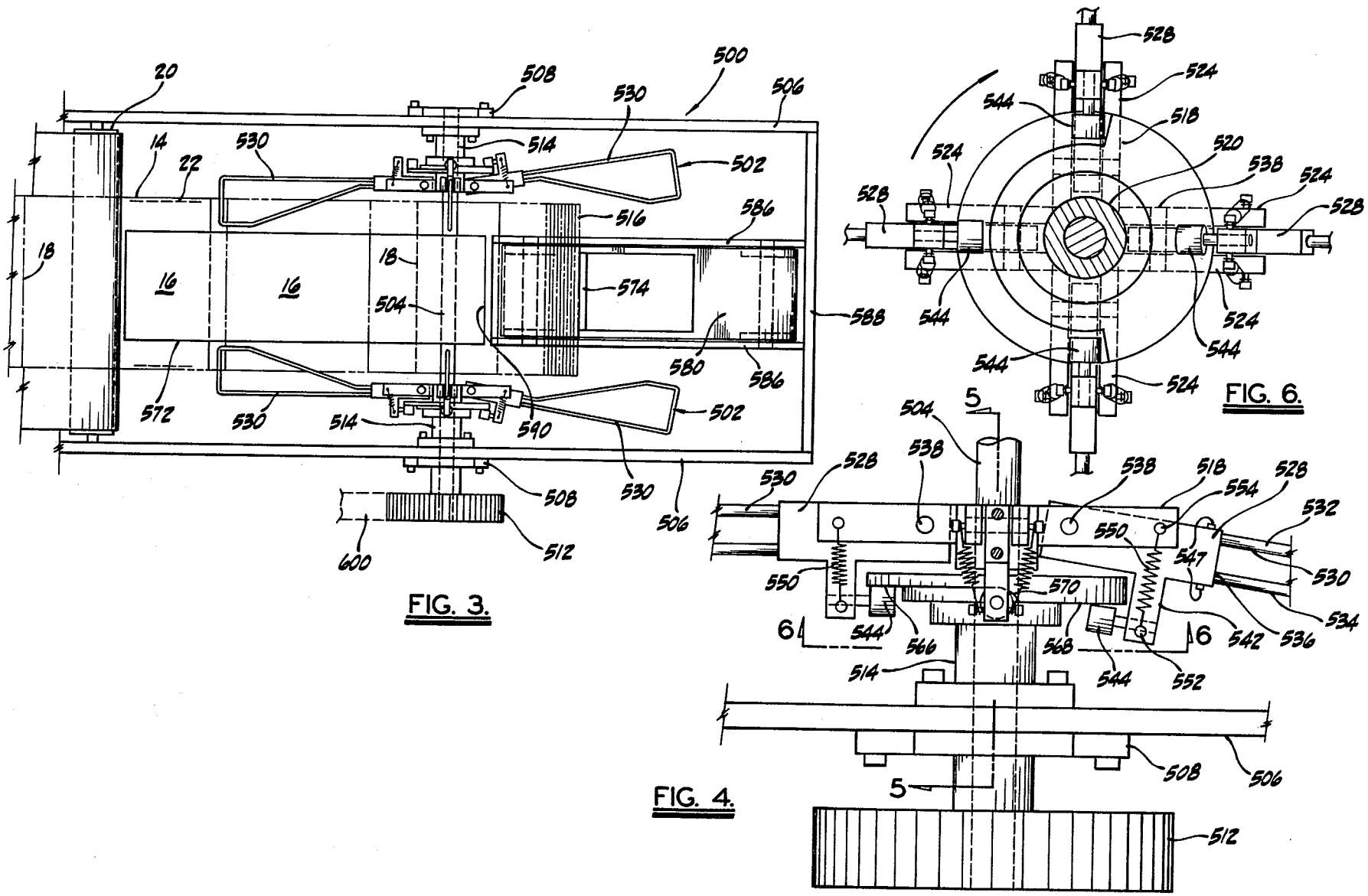
FIG. 3 is a plan view of the stacking and folding device.
FIG. 4 is an enlarged detail illustrating the cam assembly.
FIG. 6 is a cross sectional view taken on line 6—6 of FIG. 4.

Referring now by reference numerals to the drawings, and first to FIGS. 1-3, it will be understood that the stacking device, generally indicated by numeral 500, is used, in the embodiment shown, as the final station of a machine indicated by numeral 10 for processing continuous business forms. The machine 10 includes a support frame 12 providing support means for the stacking device 500 and for several other stations at which various operations are performed on a continuous elongate web 14 dispensed from a roll (not shown) carried by the other end of the frame 12. The web 14 is separated lengthwise into a plurality of individual business forms 16, such as mailing envelopes or the like, by transverse fold lines 18 and the web is conveyed lengthwise of the longitudinal axis of the machine 10 by a conveyor system which includes rollers and belt conveyor sections such as that indicated by numeral 20 in FIG. 3. The web 14 includes side perforations 22 which are engaged by pin wheels (not shown) disposed lengthwise of the machine 10 to insure accurate timing of the conveyed web and widthwise perforations along the transverse fold lines 18.

The stacking device 500 consists essentially of a pair of oppositely disposed paddle wheel assemblies 502 mounted to a shaft 504 and constituting rotatable means. The shaft 504 is rotatably mounted between upper members 506 of the support frame 12 by means of journal mounting 508 connected to said frame. The shaft 504 is provided with a gear 512 fixedly attached to the outer end thereof and driven by a drive system generally indicated by numeral 600 and constituting a drive means. As shown, the drive system includes a drive shaft 602 mounted to the side frame members 506. The drive shaft is rotated by a belt and pulley system 604 and has a drive gear 608 mounted thereon which is connected in drive relation to end gear 512 as by intermediate idler gears 610.

A cam assembly 514 constituting a cam means is fixedly attached to each frame member 506, as by fasteners, and provides a means by which the paddle wheel assemblies 502 are controlled during rotation to engage and elevate the individual sections of the web 14 during part of their rotation and disengage said web at about the top dead center position to form a fan-folded stack indicated by numeral 516.

The structure of the paddle wheel assemblies 502 and the cam assemblies 512 will now be more particularly described with reference to FIGS. 4 through 6.

Each paddle wheel assembly 502 includes a hub member 518 having a boss 520 fixedly attached to the shaft 504 as by a set screw 522, and four right-angularly related bifurcated arm members 524 extending radially from said boss. Each paddle wheel assembly 502 also includes four arm members 526 each having a base portion 528 and a removable loop portion 530 constituting radially extending portions. The loop portion 530 is configurated to provide a pair of rod members 532 and 534 which are removably connected to the base 528 as by insertion within openings 536 provided in said base portion 524, and secured thereto as by set screws 537. Each base portion 528 is pivotally connected between its associated bifurcated arm members 524 by means of a pin 538 which is received in drive-fitted relation within openings provided in said bifurcated arm members 524 and in rotatable relation within openings provided in said base portion 528. Each base portion 528 also includes an outwardly extending portion 542 which carries a cam follower assembly 544 constituting a cam follower means and consisting of a downwardly depending stub axle 546, attached to said arm portion as by a set screw 547, and a rotatable roller 548 which is engageable with the cam assembly 512 as will be described. Each base portion 526 is biased against outward movement by a pair of coil springs 550 attached between the outwardly extending portion 542 and associated bifurcated arm members 524, said springs being attached as by fasteners 552 and 554 respectively.

As best shown in FIG. 5, the cam assembly 514 includes a sleeve 556 having an end flange 558 by which it is fixedly attached to the frame member 506, and a circular cam plate 560. The cam plate 560 includes a boss 562 and is fixedly attached to sleeve 556 as by a set screw 564. This arrangement permits the sleeves 556 to be readily removed and replaced by sleeves having a different length to relocate the cam plate 560 and the paddle wheel assembly 502. Importantly, the cam plate 560 includes a cam face or track 565 consisting, in the embodiment shown of substantially semi-circular arcuate inner and outer track portions 566 and 568 which are separated by transition portions 570 at approximately top dead center and bottom dead center and are engageable by the cam follower roller 548. It will be understood that engagement between the roller 548 and the relatively offset cam track portions 566 and 568 controls the relative position of the paddle wheel arm members 526 by causing said members to pivot about the pivot pin 538. Thus, during roller engagement of the track inner portion 566 the arm members 526 take up one angular position relative to the plane of rotation of the hub member as shown in full lines in FIG. 2 and during engagement of the track outer portion 568 take up another angular position relatively outwardly disposed of said first angular position as shown in phantom outline in FIG. 2. The fixed cam assembly 514 and the cam follower assembly 544 cooperate to provide an actuating means for moving the arm members 526 into and out of engagement with the web 14, and in the embodiment shown, the arm members pivot outwardly just beyond top dead center and are returned inwardly under spring bias just before bottom dead center.

The operation of the device will be briefly described with reference to FIGS. 1 and 3. The web 14 is delivered to the paddle wheel assemblies 502 by means of a conveyor system such as that indicated by numeral 20 in FIG. 3. A table plate 572 receives the web 14 and the rotation of the paddle arm members 526 is timed to coincide with the disposition of the of the transverse fold lines 18 which separate the web 14 into individual business forms 16. It will be understood that the generally horizontal forward arm members of the paddle wheel assemblies 502 are disposed inwardly in underlying relationship to the web 14 as clearly shown in FIG. 3. Because of the relationship between the cam track and the cam follower 544, the arm members 526 remain inwardly disposed until they rotate into an approximately top dead center position with the result that the web sections 16 on either side of the fold line 18 are lifted and folded on each side of said arm members. Just beyond the top dead center position, the arm members 526 carrying said web are cammed outwardly to disengage the now folded web which continues its longitudinal motion to join the fan-fold stack 516 which rests against a stack support 574, and the arm members continue to rotate in this position until bottom dead center is reached thereby clearing said stack.

The stack support 574, in the preferred embodiment, is carried by a belt conveyor generally indicated by numeral 580. The belt conveyor 580 includes front and rear rollers 582 and 584 mounted between a pair of horizontal frame members 586 extending between the frame end member 588 and an auxiliary support leg 590. The belt conveyor 580 is normally stationary but can be actuated to move the stack support 574 rearwardly, as desired, to accommodate the size of the stack 516 as it grows in length. As shown in FIG. 1, the belt conveyor 580 is actuated by a drive assembly 592, connected to a sprocket 594 fixedly attached to the front roller drive shaft 596.

The stacking device 500 is adapted to process a range of sizes of individual business forms which can vary both as to length and width. The width adjustment is effectuated by removing the cam sleeves 556, replacing them with sleeves of a different length and relocating the cam plates 560 and the paddle wheel assemblies 502.

The length adjustment is effectuated by removing the arm member loop portions 530 and by replacing them with loop portions of a different length and by removing and replacing the paddle wheel gear 512 to change the angular speed of the paddle wheel assemblies 502. By changing the angular speed of the paddle wheel assemblies 502 the web speed can be kept constant and the drive assembly by which this is accomplished will now be described.

The paddle wheel assemblies 502 are timed to rotate once for every eight web sections so that alternate fold lines are engaged by consecutive paddle wheel arm members. When the length of the individual web sections 16 is changed, for example from 12 inches to 16 inches, the angular speed of the paddle wheel assemblies 502 is changed so that the speed of the web 14 remains constant.

Figure 7:
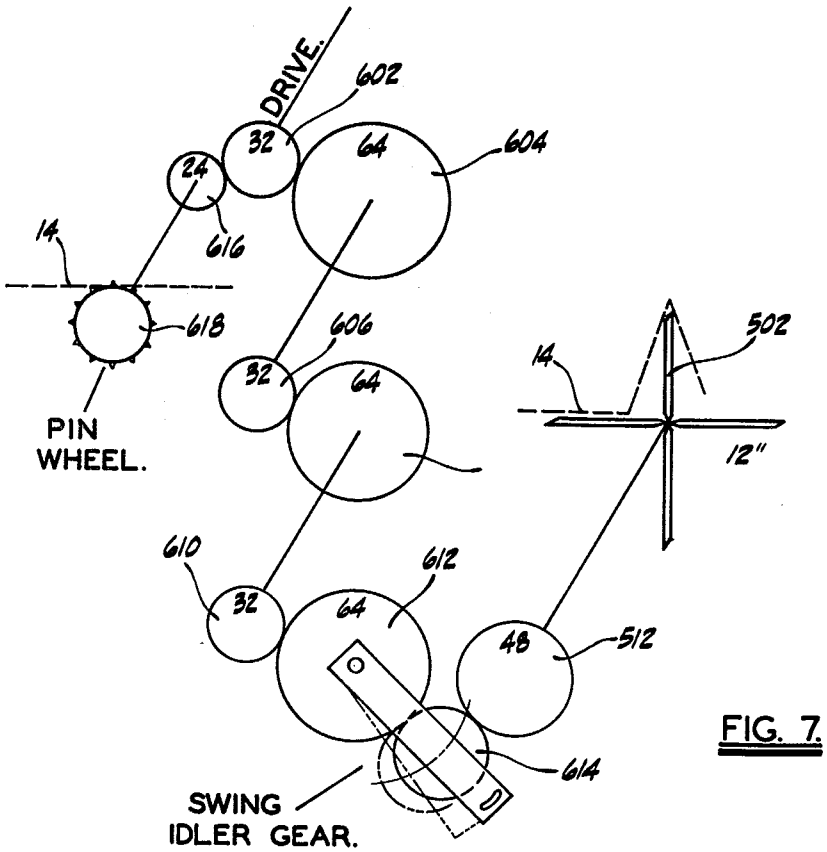
FIG. 7 is a schematic view of a drive assembly.

The drive assembly 600 by which this is accomplished is shown schematically in FIG. 7. As shown, the assembly consists of a drive gear 602 (32 teeth) and a gear reduction system consisting of gears 604, 608, 612 (64 teeth each) and gears 606, 610 (32 teeth each) which provide 2:1 reductions and produce an overall reduction at gear 612 of 8:1. The speed of the paddle wheel assemblies 502 depends on the size of gear 512 which is connected to gear 612 through the medium of a swing idler gear 614. The swing idler gear 614 permits gear 512 to be removed and replaced by another gear having a different pitch circle diameter depending on the length of the web sections 16 which are to be folded.

The drive gear 602 (32 teeth) drives a pin wheel 618 through the medium of gear 616 (24 teeth). The pin wheel is 12 inches in circumference and is provided with 12 pins. Each revolution of the pin wheel 618 moves the web 12 inches. When the web sections are 12 inches in length and the paddle wheel arms are 12 inches long from the center of rotation thereof, then with the arrangement shown in FIG. 7, gear 612 rotates $\frac{3}{4}$ of one-eighth of one revolution for each revolution of the 12 inch pin wheel 618. Thus, in order to rotate the paddle wheel one-quarter of a revolution for each 24 inches of web (i.e. two folded 12 inch sections) the paddle wheel gear 512 must be $\frac{3}{4}$ of the size of gear 612 i.e. 48 teeth. When 16 inch web sections are to be processed, gear 512 is the same size as gear 612 i.e. 64 teeth.

I claim as my invention:

1. A device for fan-folding and stacking a continuous elongate web of the type which is separated lengthwise into a plurality of connected sections by transverse separation lines, the device comprising:

(a) support means having a longitudinal axis and opposed sides and including means for conveying the web longitudinally along the support means, (b) rotatable means including a plurality of radial arm means mounted to the support means for rotation about an axis transverse to the longitudinal axis of the support means, said arm means being movable transversely relative to said longitudinal axis into and out of engagement with the web, (c) actuating means carried by the support means and engageable with the rotatable means for selectively moving said arm means into engagement with the web to fold the web and out of engagement with the web to release the web, and (d) drive means operatively connected in drive relation to said rotatable means.

2. A device as defined in claim 1, in which:

(e) the arm means has a radial length which is adjustable.

3. A device as defined in claim 2, in which:

(e) the drive means includes means for changing the angular speed of the rotating arm means and maintaining the speed of the web at a constant rate.

4. A device as defined in claim 3, in which:

(f) said speed change means includes a drive gear removably mounted to the support means in drive relation to the rotating arm means said gear being replacable by another gear having a different pitch circle diameter.

5. A device for fan-folding and stacking a continuous elongate web of the type which is separated lengthwise into a plurality of connected sections by transverse separation lines, the device comprising:

(a) support means having a longitudinal axis and opposed sides and including means for conveying the web, (b) rotatable means including a plurality of radial arm means mounted to the support means for rotation about an axis transverse to the longitudinal axis of the support means said arm means being movable into and out of engagement with the web, (c) actuating means carried by the support means and engageable with the rotatable means for selectively moving said arm means into engagement with the web to fold the web and out of engagement with the web to release the web, (d) drive means operatively connected in drive relation to said rotatable means, and (e) the rotating means including a hub means rotatively mounted to the support means and each radial arm means being pivotally connected to said hub means for swinging movement transversely of the plane of rotation of the hub means.

6. A device as defined in claim 5, in which:

(f) the axis of rotation of the hub means is substantially horizontal.

7. A device as defined in claim 5, in which:

(f) the actuating means includes a cam means fixedly attached to the support means and a cam follower means carried by each arm means and engageable with said cam means as said rotatable means rotates.

8. A device as defined in claim 7, in which:

(g) the cam means includes a pair of oppositely disposed cam members each having a cam face circumferentially disposed about the axis of rotation of the hub means including an arcuate inner portion and an arcuate outer portion, (h) the hub means includes a pair of oppositely disposed hub members rotated by the drive means and the arm means includes a plurality of arm members disposed on each side of the longitudinal axis of the support means, each arm member being pivotally connected to a hub member and each arm member including a cam follower radially spaced from the axis of rotation of the hub member and engageable with the cam face inner portion and outer portion to move the arm members inwardly and outwardly during a portion of the rotation of the hub members, and (i) spring bias means connects the hub members to each arm member tending to bias said arm members against said outward movement.

9. A device as defined in claim 8, in which:

(j) the hub member includes four right angularly related radially extending portions, and (k) each arm member includes a base portion pivotally connected to one of said hub member radially extending portions and a radially extending web engagement portion connected to said base portion.

10. A device as defined in claim 8, in which:

(j) each arm member includes a base portion pivotally connected to said hub member and a radially extending web engagement portion connected to said base portion in removable relation for replacement of said web engagement portion by another web engagement portion of different length.

11. A device as defined in claim 8, in which:

(j) each cam member includes a flange disposed about the axis of rotation of the hub member and having a substantially circular cam face providing said arcuate portions, (k) each arm member includes a base portion pivotally connected to said hub member and a radially extending web engagement portion connected to said base portion, and said base portion includes an outwardly extending portion disposed in outwardly overhanging relation to the cam member flange, and (l) each cam follower includes a rotatable member depending from said extending portion and engageable with said flange member cam face.

12. A device as defined in claim 8, in which:

(j) the cam means including means for adjusting the position of each cam face longitudinally of axis of the hub means.

* * * * *